US006644292B1

(12) United States Patent
Ganson

(10) Patent No.: US 6,644,292 B1
(45) Date of Patent: Nov. 11, 2003

(54) CATAPULT GAME DEVICE, SYSTEM AND METHOD

(75) Inventor: Arthur Ganson, Somerville, MA (US)

(73) Assignee: HandsonToys, Inc., Wilmington, MA (US)

( * ) Notice: Subject to any disclaimer, the term of this patent is extended or adjusted under 35 U.S.C. 154(b) by 0 days.

(21) Appl. No.: 10/074,476

(22) Filed: Feb. 13, 2002

Related U.S. Application Data

(60) Provisional application No. 60/268,426, filed on Feb. 13, 2001.

(51) Int. Cl.[7] ..... F41B 3/00
(52) U.S. Cl. ..... 124/7; 124/16; 124/36
(58) Field of Search ..... 124/7, 16, 36

(56) References Cited

U.S. PATENT DOCUMENTS 2,080,958 A * 5/1937 Beasley et al.
2,192,096 A * 2/1940 Minger
3,731,932 A * 5/1973 Breslow et al.
4,111,179 A * 9/1978 Hashimoto ..... 127/7
4,509,760 A * 4/1985 Goldfarb et al.
4,995,371 A * 2/1991 Kuizinas ..... 124/7
6,343,597 B1 * 2/2002 Spikes ..... 124/7

* cited by examiner

*Primary Examiner*—John A. Ricci
(74) *Attorney, Agent, or Firm*—Brian M. Dingman, Esq.; Mirick, O'Connell, DeMallie & Lougee, LLP

(57) ABSTRACT

A catapult device for a catapult game, including a projectile-throwing mechanism, and a projectile catch member. The projectile release angle of the mechanism, and the projectile throw force of the mechanism are adjustable. The throwing mechanism is automatically released upon the impact with sufficient force of a projectile on the projectile catch member. Also disclosed is a game system and a game playing method using a number of such devices.

16 Claims, 12 Drawing Sheets

CATAPULT GAME DEVICE, SYSTEM AND METHOD

This application claims the benefit of Provisional Ser. No. 60/268,426, filed Feb.13, 2001.

FIELD OF THE INVENTION

This invention relates to a game that uses a number of small catapults.

BACKGROUND OF THE INVENTION

Catapults have existed for centuries or longer. They are typically large unwieldy machines that are difficult to move, position, load, and fire. Their primary use has been in warfare.

In contrast to this, children's games typically must be relatively small, inexpensive, and easy to assemble and use. More importantly, children's games, in order to be successful, must be fun to use. Parents also look for toys and games that are interesting and stimulating and will contribute to a child's development.

SUMMARY OF THE INVENTION

This invention features a catapult game system and method. The game includes a number of catapult game devices that are adapted to be automatically triggered to launch a projectile when another projectile lands on a projectile catch area of the device. The devices can be used together by arranging the catapult devices so that each device launches a projectile to land on the projectile catch area of another device, which automatically triggers that other device to launch its projectile toward yet another projectile catch area of another catapult. This way, by using at least two (and probably at least three) catapults, the players can attempt to maintain a continuous flow of projectiles, with each player using one catapult.

It is therefore an object of this invention to provide a catapult game system and method.

It is a further object of this invention to provide such a system and method that is fun for one child or a group of children.

It is a further object of this invention to provide such a system and method that contributes to development of manual dexterity.

It is a further object of this invention to provide such a system and method that contributes to a child's basic understanding of motion and Newton's laws of physics.

This invention features a catapult game system, comprising a plurality of catapult devices, each comprising a projectile-throwing mechanism; a projectile catch member; means for adjusting the projectile release angle of the mechanism; means for adjusting the projectile throw force of the mechanism; and means for automatically enabling the throwing mechanism upon the impact with sufficient force of a projectile on the projectile catch member.

Also featured is a catapult game method using a plurality of catapults, each comprising a projectile-throwing mechanism; a projectile catch member; means for adjusting the projectile release angle of the mechanism; means for adjusting the projectile throw force of the mechanism; and means for automatically enabling the throwing mechanism upon the impact with sufficient force of a projectile on the projectile catch member, the game comprising aligning at least two catapults so that at least one catapult sends a projectile to or towards the projectile catch member of another catapult; and tripping one catapult to send its projectile toward the catch member of another catapult, to start a chain reaction of at least one and preferably two or more projectile catches and releases that can be continued by resetting of the catapults.

The inventive catapult game device for a catapult game comprises a projectile-throwing mechanism; a projectile catch member; means for adjusting the projectile release angle of the mechanism; means for adjusting the projectile throw force of the mechanism; and means for automatically enabling the throwing mechanism upon the impact with sufficient force of a projectile on the projectile catch member. The projectile-throwing mechanism may comprise a throwing arm. The means for automatically causing may comprise a throwing arm triggering mechanism coupled to the catch member, for translating motion of the catch member into release of the throwing arm. The triggering mechanism may comprise a triggering arm coupled at one end to the catch member. The triggering arm may be releasably coupled to the throwing arm. The releasable coupling may be accomplished with a catch. The triggering arm may be adapted to pivot about an axis or bend, to release the throwing arm from the triggering arm.

The throwing arm may be adapted to pivot about a substantially horizontal axis. The throwing arm may define a projectile-accepting portion for releasably holding a projectile. The projectile may have a defined shape in a throwing arm-contacting portion, and the projectile-accepting portion of the throwing arm may then have a complementary shape.

The means for adjusting the projectile release angle may comprise an adjustable cam mechanism that accomplishes a projectile throwing mechanism stop point. The means for adjusting the projectile throw force may comprise a spring coupled to the projectile throwing mechanism, and means for adjusting the spring tension. The means for adjusting the spring tension may comprise an adjustable cam mechanism that contacts the spring.

The catapult may further comprise a base for supporting the catapult on a surface. The catapult may still further comprise means for rotating the projectile throwing mechanism relative to the base about a substantially vertical axis, to allow the throw position to be changed without moving the base. The base may comprise a plurality of lower feet. The feet may comprise a non-skid lower surface, to help maintain the catapult in position.

BRIEF DESCRIPTION OF THE DRAWINGS

Other objects, features and advantages will occur to those skilled in the art from the following description of the preferred embodiments, and the accompanying drawings in which.

DETAILED DESCRIPTION OF THE PREFERRED EMBODIMENTS

Figure 1:
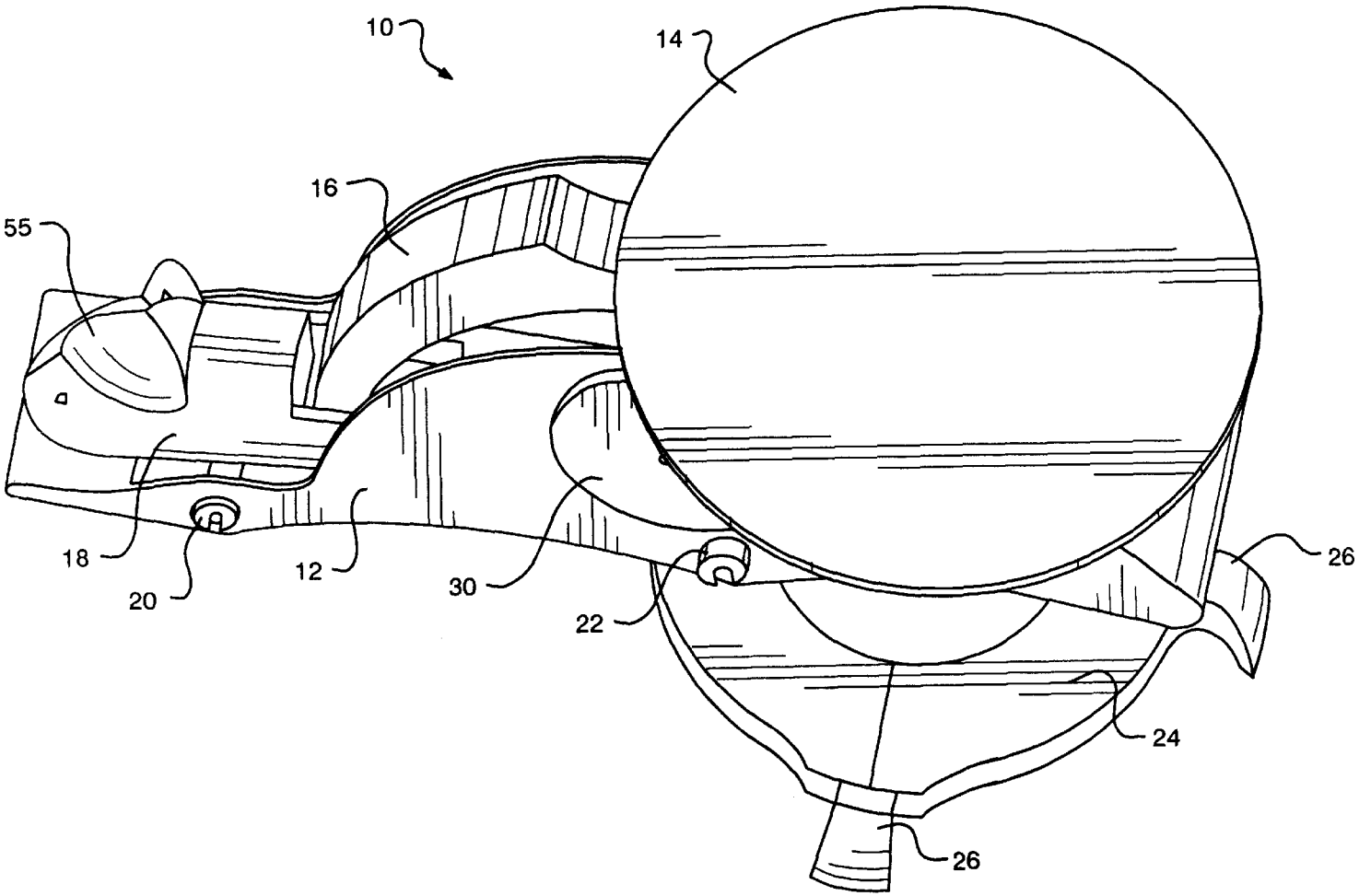
FIG. 1 is a top perspective view of the preferred embodiment of a catapult game device of this invention, also useful in the game system and method of this invention.
Figure 2:
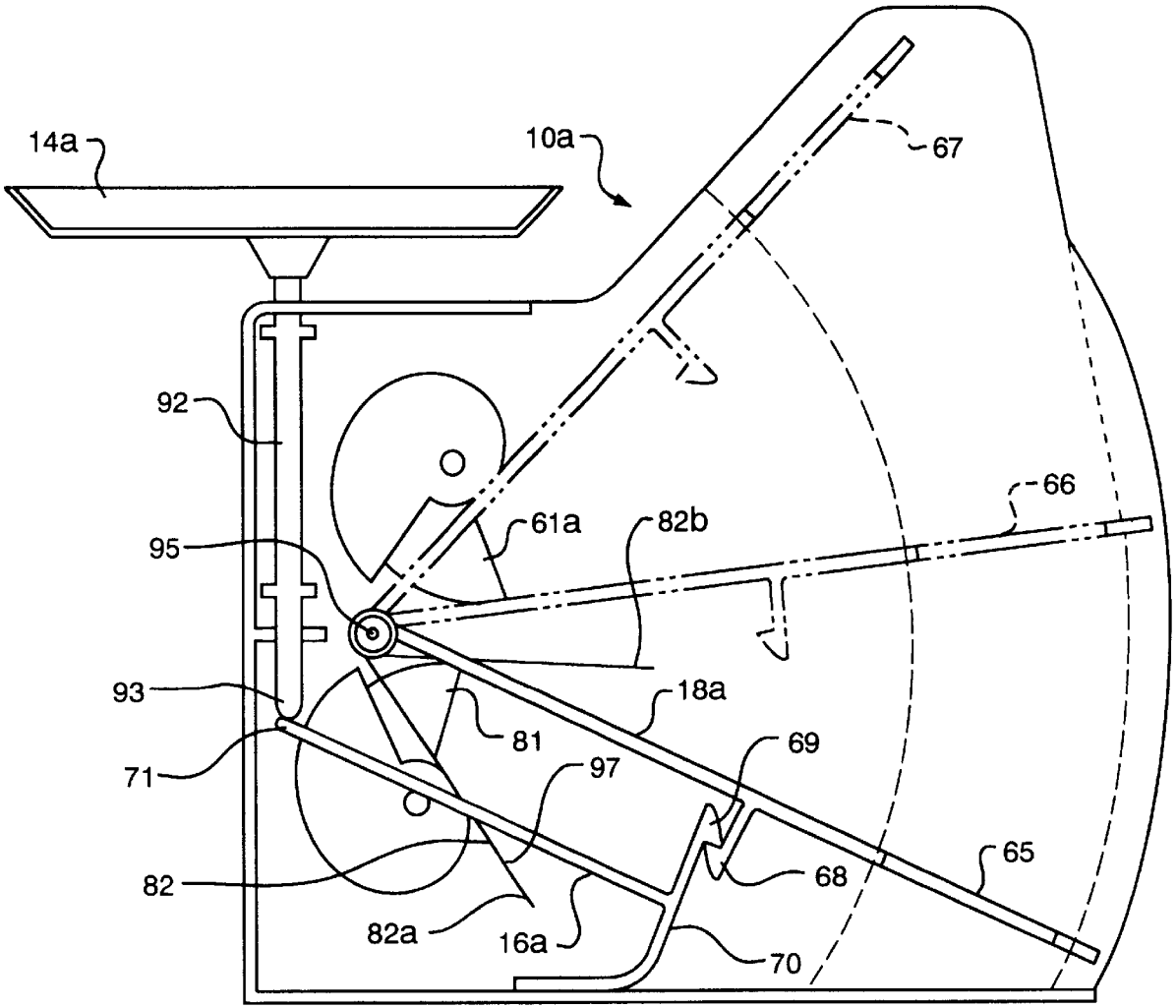
FIG. 2 is a partial side view of an alternative embodiment of a catapult game device for this invention.
Figure 3A:
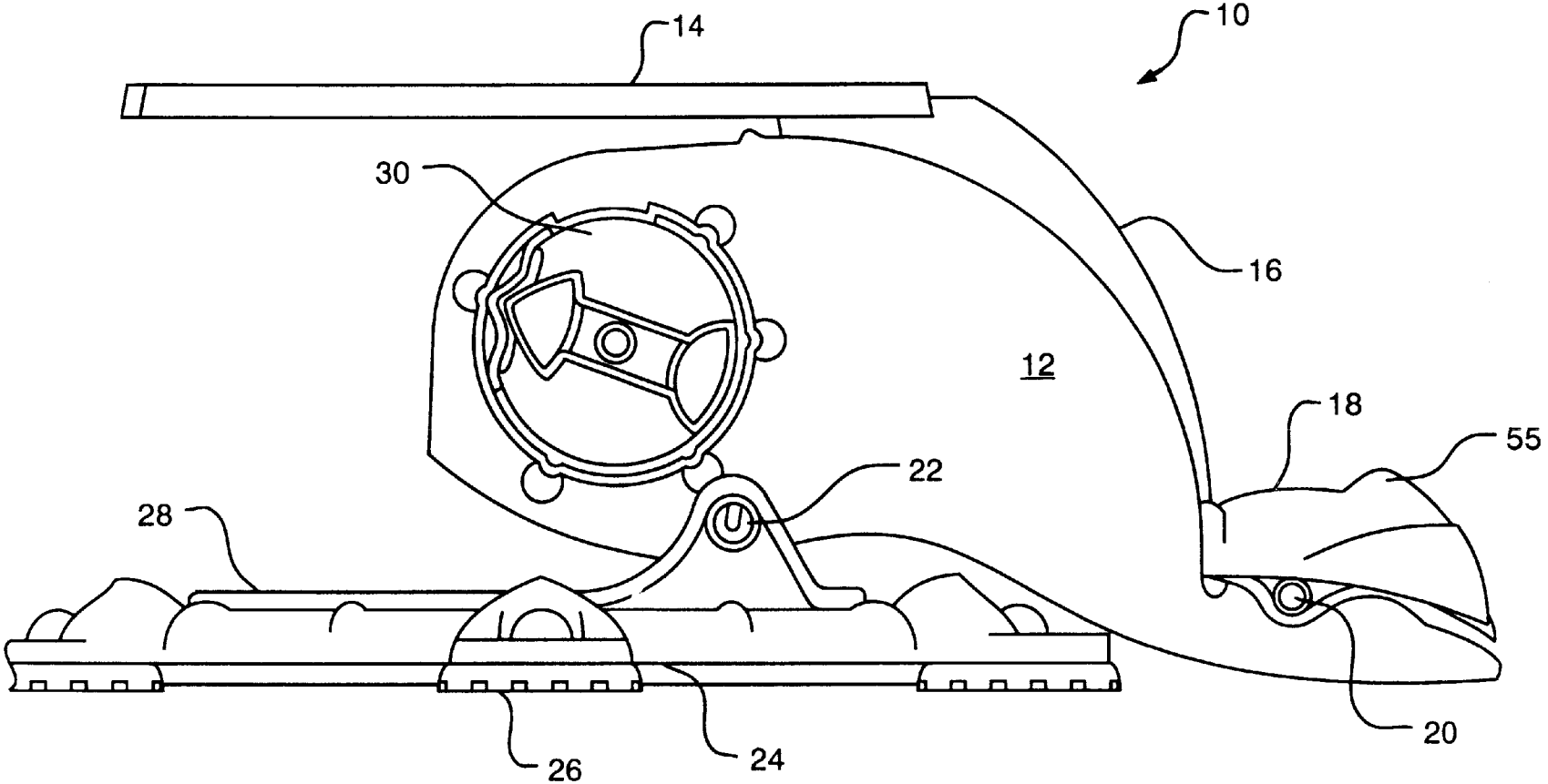
FIG. 3*a* is a side view of the catapult device of FIG. 1.
Figure 3B:
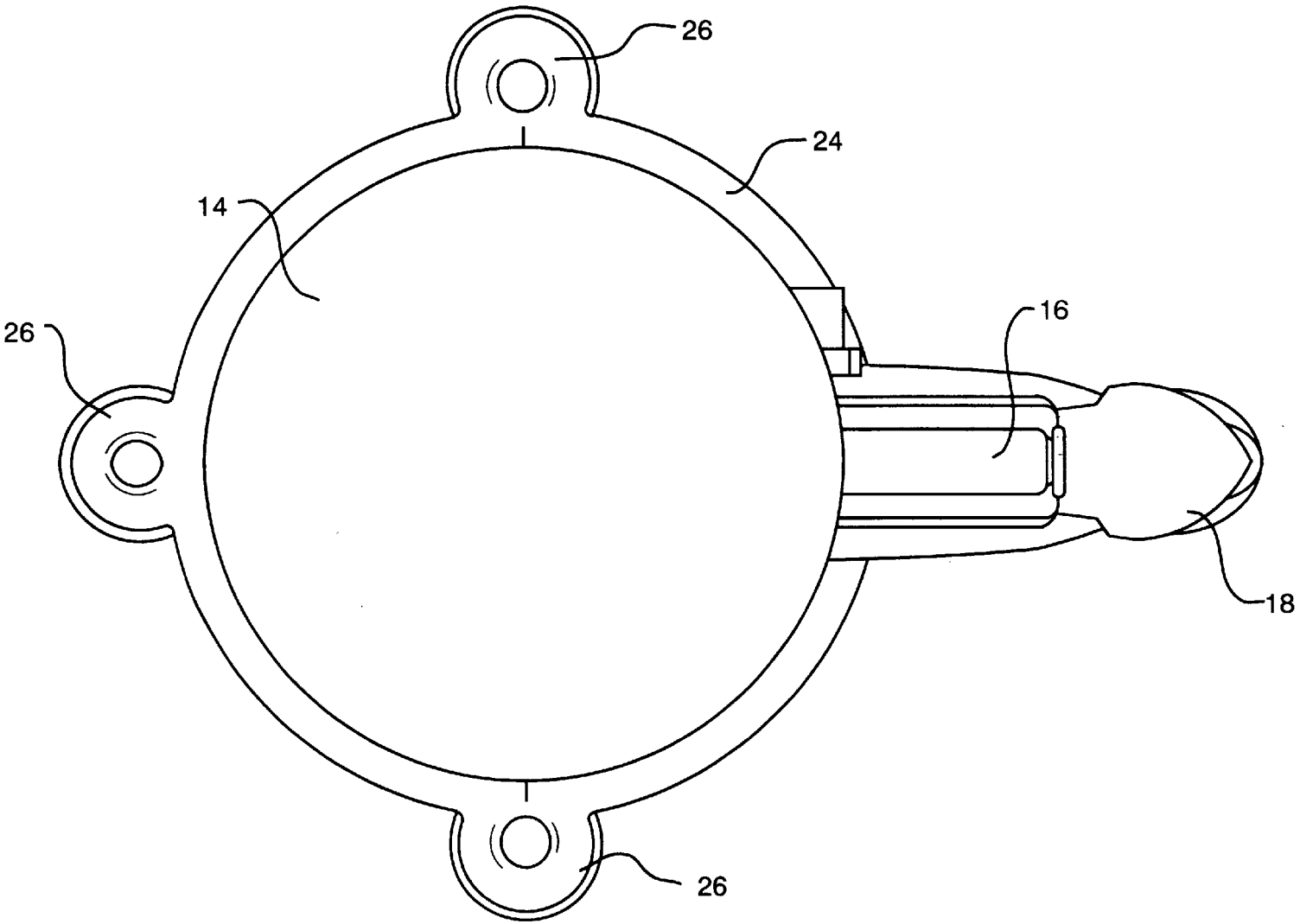
FIG. 3*b* is a top view of the catapult of FIG. 1.
Figure 4A:
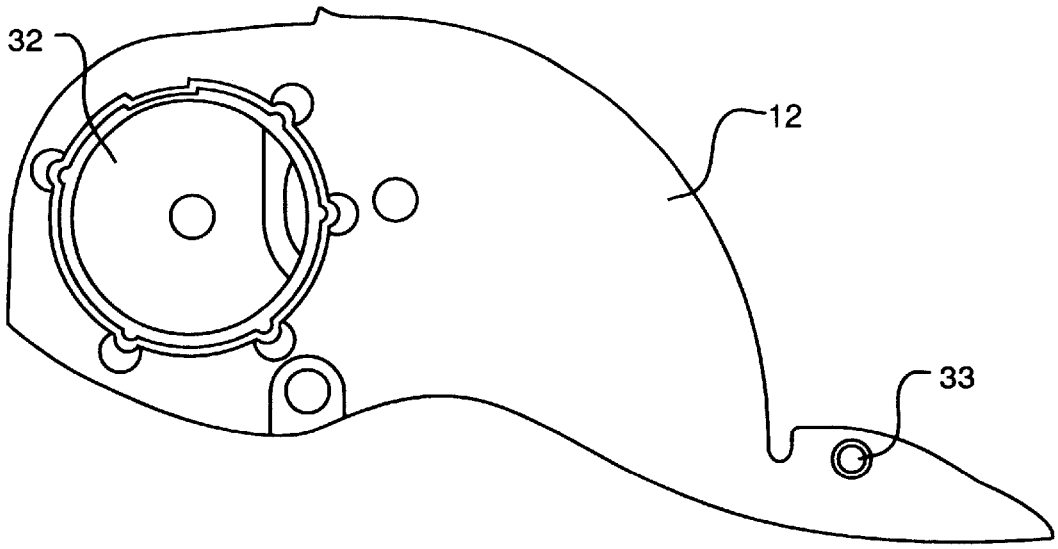
FIGS. 4*a* and 4*b* are side and top views, respectively, of the catapult body of the catapult of FIG. 1.
Figure 4B:
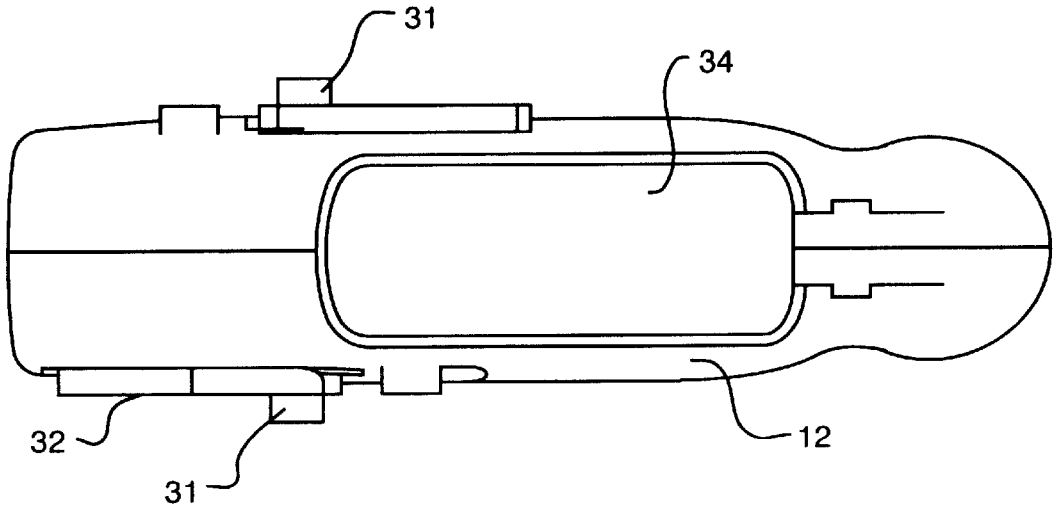
Figure 5:
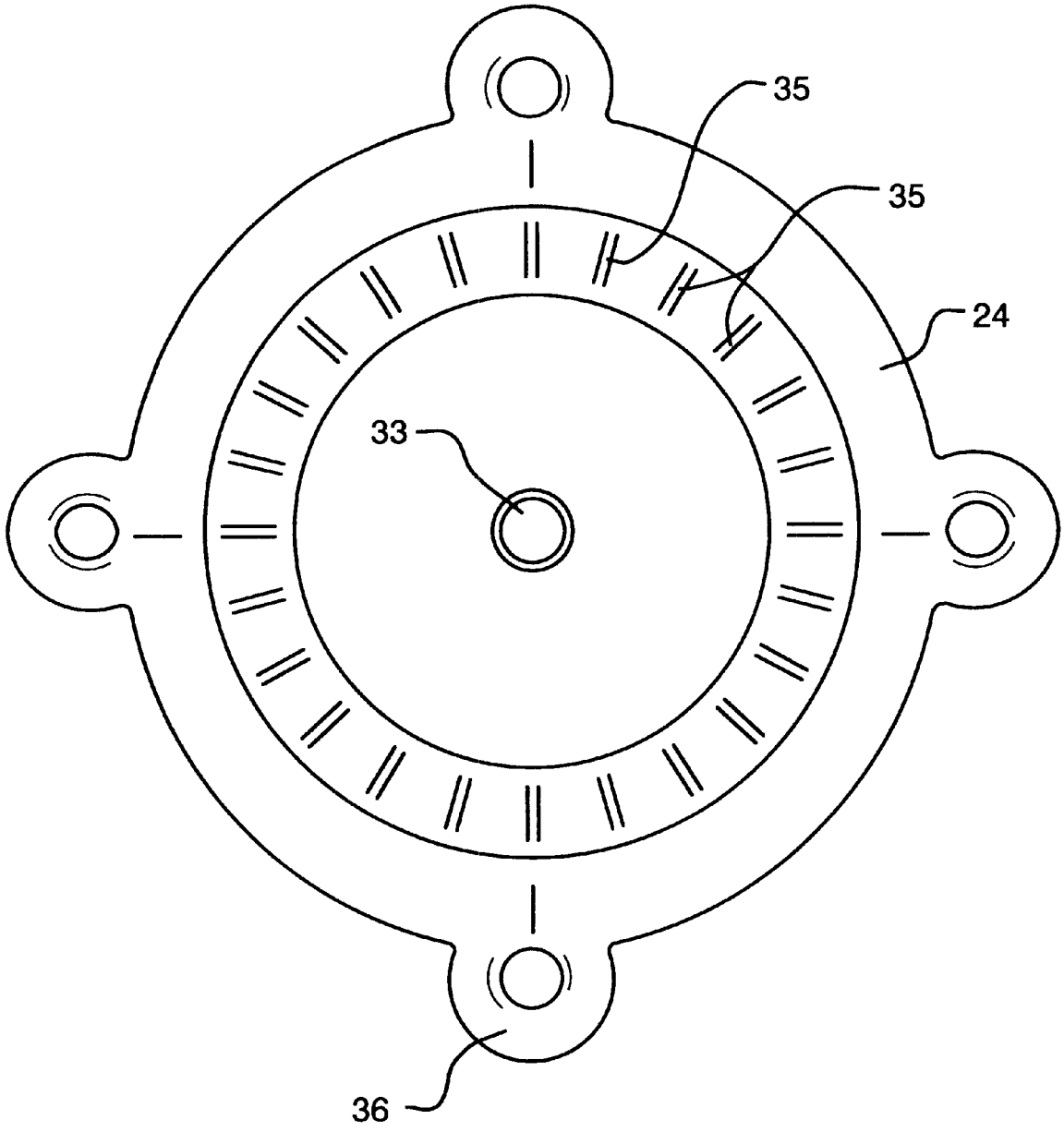
FIG. 5 is a top view of the base of the catapult of FIG. 1.
Figure 6:
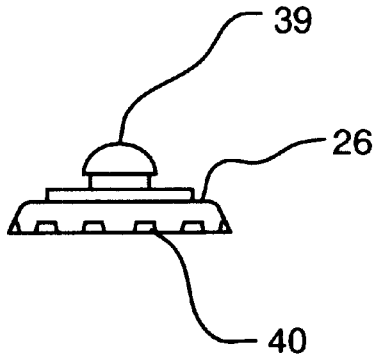
FIG. 6 is a side view of one of the feet for the catapult of FIG. 1.
Figure 7A:
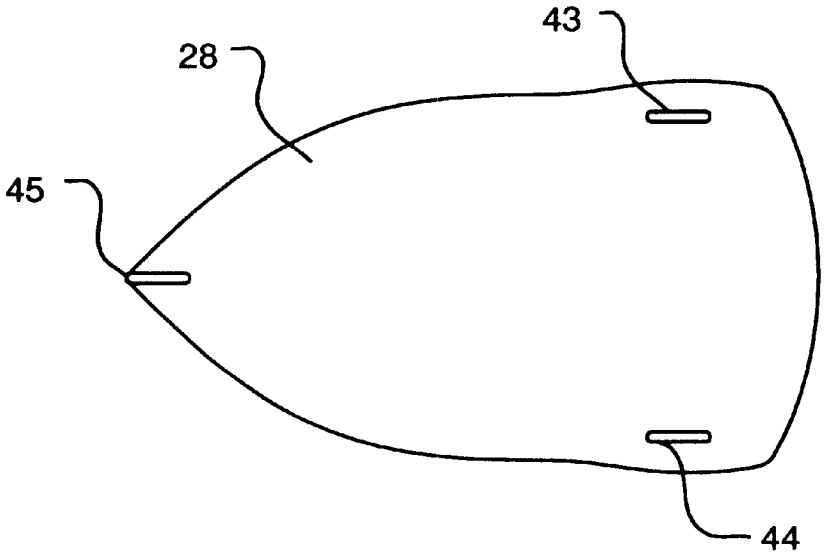
FIGS. 7*a*, 7*b* and 7*c* are top, side and end views, respectively, of the intermediate member of the catapult of FIG. 1.
Figure 7B:
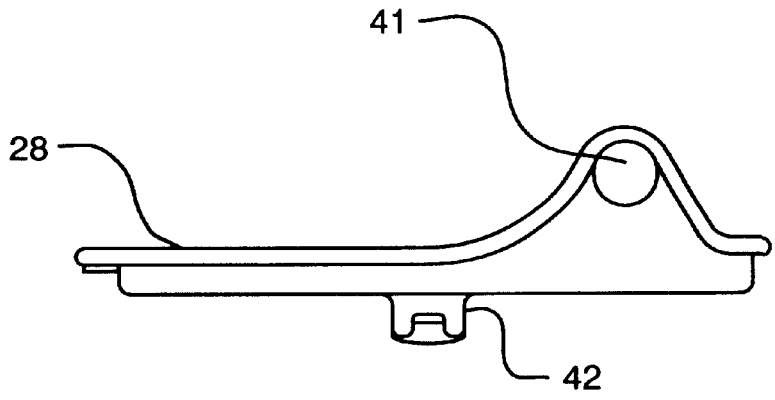
Figure 7C:
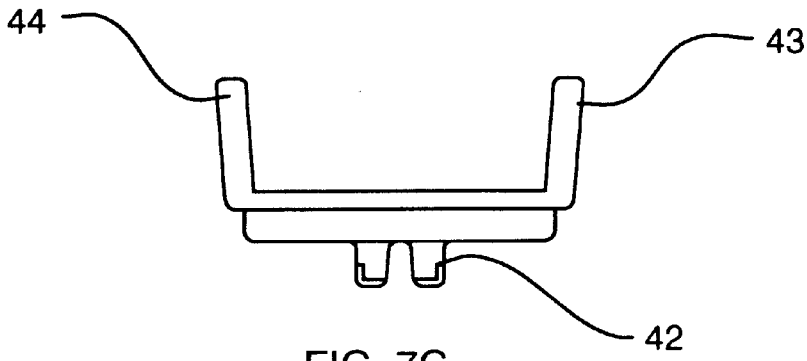
Figure 8C:
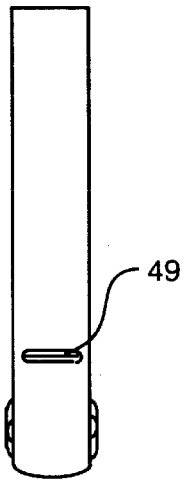
FIGS. 8*a*, 8*b* and 8*c* are side, top and end views, respectively, of the catapult triggering arm for the catapult of FIG. 1.
Figure 8B:
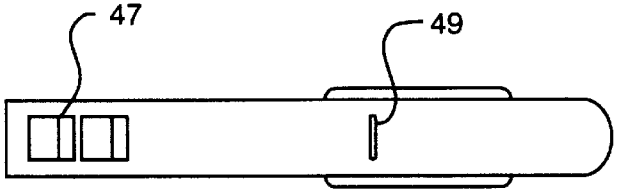
Figure 8A:
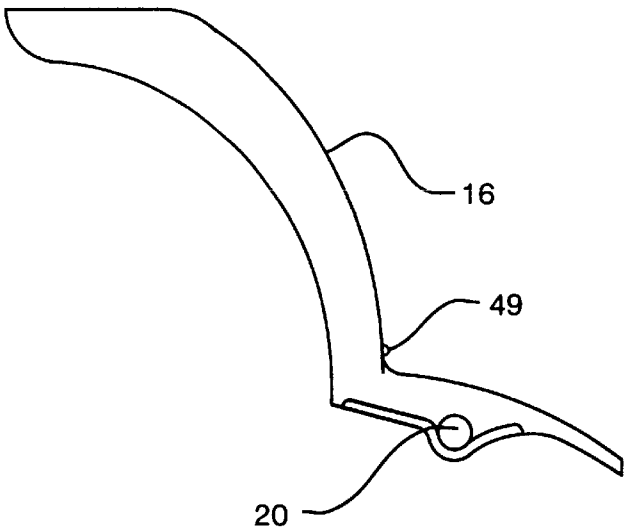
Figure 9B:
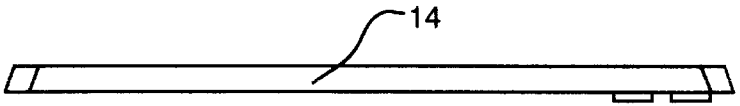
FIGS. 9*a* and 9*b* are top and side views, respectively, of the catch tray of the catapult of FIG. 1.
Figure 9A:
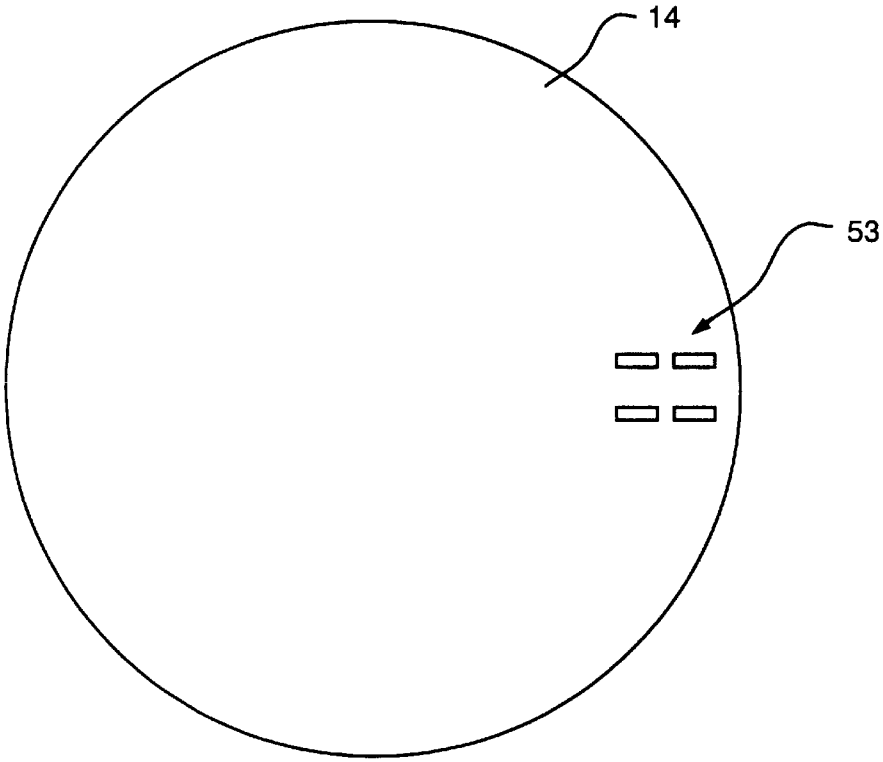
Figure 10B:
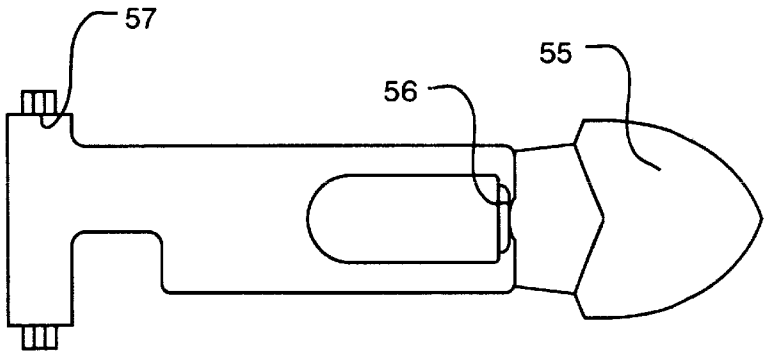
FIGS. 10*a* and 10*b* are side and top views, respectively, of the throw arm of the catapult of FIG. 1.
Figure 10A:
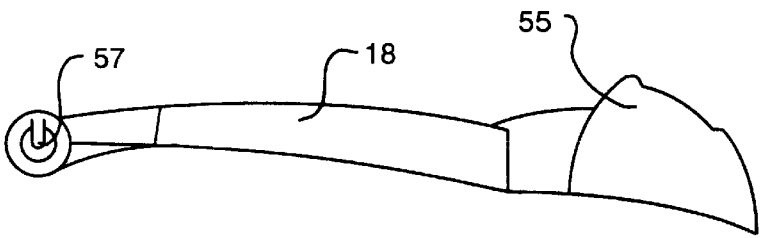
Figure 11B:
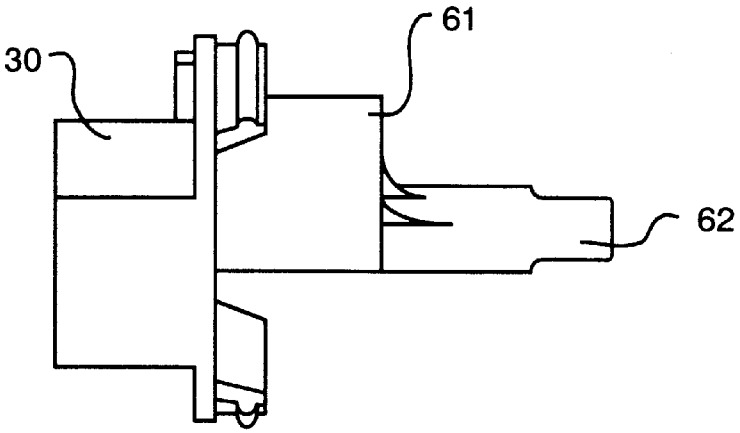
FIGS. 11*a* and 11*b* are side and top views, respectively, of the projectile release set point knob for the catapult of FIG. 1.
Figure 11A:
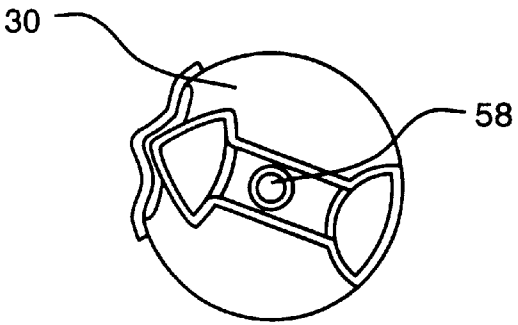

The preferred embodiment of the catapult is shown and described in FIGS. 1 and 3–11 of the drawings. An alternative embodiment is shown in FIG. 2. The catapult preferably includes an arm that throws a projectile that is placed on the arm. Preferably, the arm is set into action by the release of a trigger mechanism. The trigger mechanism may be set off by the force of another projectile landing on a catch tray of the catapult. Also, preferably the tension applied to the arm is adjustable, and the arm's projectile release point is adjustable. These adjustment capabilities allow the catapult's projectile throw angle and velocity to be set within an available range, which provides for variety in the uses of the catapults.

Preferably, the adjustable arm tension (i.e., throw force) is accomplished with a torsion spring that can be wound and unwound as desired, to adjust the spring force. This is preferably accomplished with a knob that turns a cam that contacts the spring end, although other means of tension adjustment are also contemplated within the scope of the invention.

The adjustable throw arm release point can be accomplished using an adjustable cam, which is contacted by the arm during its travel upwards, to define an adjustable arm travel end point. This is also the projectile release point. Other means of accomplishing this result are also within the scope of this invention.

The catch tray can be any size or shape, and the arm release mechanism can also be accomplished as desired. In the preferred embodiment, the catch tray has an arm with a lower portion that releasably engages the throwing arm. When a sufficient force is applied to the tray (loosely calibrated to be the weight of a projectile traveling at a certain velocity), the catch tray arm pivots about a pivot point or is bent sufficiently to release the catch, which frees the throw arm, which is then forced upwards by the spring tension. Other means of accomplishing this automatic throw arm release are also contemplated. Manual release can also be accomplished.

Two other features that may be included in the invention are also shown in the drawings. A uniquely-shaped projectile can be used by providing a projectile stabilizer protrusion on the end of the throw arm. The projectile would be made to have a complimentary-shaped receiving portion. This would help ensure that projectiles having the right size, shape and/or weight would be used with the device. Also, the projectiles could be made in a fashion (e.g. soft and light) in which they would not cause injury. Another feature is a non-skid and/or suction cup bottom, that would help to keep the catapult in a stable position on the floor or a table top; when the projectile is released, some force is transferred to the catapult body, which tends to make the catapult "walk" across the surface. To play the multiple-user game version described below, it is desirable to keep the catapults in (or close to) a fixed position.

The preferred embodiment of the invention is shown in FIGS. 1 and 3–11. Device 10 comprises catapult body 12, which is pivotably fixed at pivot axis 12 to intermediate member 28, that is itself rotationally fixed to base member 24 having gripping feet 26. Catch tray 14 is coupled to arm 16 that pivots about axis 20. Projectile launching member or throw arm 18 has portion 55 that accepts the uniquely-shaped projectile having a bottom shape that matches the shape of portion 55. Knob 30 provides an adjustable projectile release point.

FIG. 2 schematically depicts an alternative embodiment that helps in understanding the functionality and mechanisms of both this embodiment and the preferred embodiment. Catapult device 10*a* includes throw arm 66 that pivots about pivot 95 as urged by launch force coil spring 82. Cam 81 sets the spring tension by moving extending spring end 97 from a lower position 82*a* that defines the lowest spring tension available to the upper position 82*b* that defines the greatest spring tension available. It can be seen that turning cam 81 in a counter clockwise direction when the spring is at point 82*a* pushes the spring end up to the highest position of point 82*b*. The launch arm end point is accomplished with cam 61*a* which allows the end point to be set from the lowest point 66 to a highest point 67. This changes the throw angle of the device.

In this embodiment, throw arm 18*a* is held in the cocked position 65 by slipping catch 68 under catch 69 of flexible portion 70 of triggering arm 16*a*. In this embodiment, catch 68 is released from catch 69 by downward force applied to catch tray 14*a* which pushes distal end 93 of pushing rod 92 against distal end 71 of catapult triggering arm 16*a*. This causes portion 70 to bend so that catch 69 moves to the left in the picture and releases catch 68. Throw arm 18*a* is then pushed up by the force of spring 82.

In the preferred embodiment shown in the other figures, this same cam adjustment action is used to both the launch spring and the launch arm end point.

Feet 26 (FIG. 6) include projecting portions 39 that fit in openings within portions 36 of base 24. Bottoms 40 of feet 26 preferably have gripping rubber or other soft/gripping portions that help to inhibit the catapult from moving due to the force of launches and catches. Base 24 also has notches 35 that help to hold the device in a particular launch direction.

Member 28 (FIG. 7) sits on top of base 24 (FIG. 5), with projecting portion 42 fitting in opening 33, thus allowing the rotation about a vertical axis of member 28 relative to member 24. Projections 43 and 44 define the opening that accepts projecting portions 31 of member 12. This allows member 12 to pivot on horizontal axis 22, so that not all of the recoil force created on projectile launch is transferred to base 24. This helps to maintain the catapult in place.

Arm 16 (FIG. 8) includes catch projection 49 that holds projection 56 in throw arm 18 (FIG. 10) when the device is in the launch position. Then, when force is applied to tray 14, the resulting downward movement of tray 14 causes arm 16 to pivot about axis 20, and thus release arm 18, which itself pivots about portion 57. Cam portion 61 of knob 30 lies in the path of arm 18 so that arm 18 strikes portion 61, to suddenly stop the motion of arm 18 and thus launch the projectile fitted on portion 55. Cam 61 thus provides an adjustable projectile release point by stopping the motion of arm 18 at a variable point.

Tray 14 (FIG. 9) has projections 53 that fit in receiving openings 47 in member 16, so that when downward force is applied on tray 14, such as for example by the impact of a projectile, member 16 is pushed down and thus pivots on axis 20 to release member 18 and therefore fire the projectile.

One manner of playing a game with three of these catapults is as follows. A first catapult is used to throw a projectile along a path, into the projectile catch area of a second catapult, which is thus caused to launch its projectile along a path to the catch area of a third catapult, which then launches its projectile along a path to the catch area back to the first catapult. Each user (other than the starting user, who begins by manually releasing the catch arm) must retrieve a projectile after its lands on the player's catapult projectile catch area, reset the throw arm, and immediately place the projectile (or a spare projectile) on the throw arm, before another projectile lands on the player's catapult. In this fashion, the projectiles are continuously passed around in a loop. The number of catapults, and the placement and distance between the catapults is determined in advance, with the proper spring tension/arm release points determined for the desired throws. Any number of players can play this game.

Other embodiments will occur to those skilled in the art and are within the following claims:

What is claimed is:

1. A catapult game method using a plurality of catapults, each comprising a projectile-throwing mechanism; a projectile catch member; means for adjusting the projectile release angle of the mechanism; means for adjusting the projectile throw force of the mechanism; and means for automatically enabling the throwing mechanism upon the impact with sufficient force of a projectile on the projectile catch member, the game comprising:

aligning at least two catapults so that each catapult sends a projectile to or towards the projectile catch member of another catapult; and tripping one catapult to send its projectile toward the catch member of another catapult, to start a chain reaction of projectile catches and releases that can be continued by resetting of the catapults.

2. A catapult device for a catapult game, comprising:

a projectile-throwing mechanism;

a projectile catch member;

means for adjusting the projectile release angle of the mechanism;

a spring coupled to the projectile throwing mechanism and an adjustable cam mechanism that contacts the spring, for adjusting the projectile throw force of the mechanism; and means for automatically enabling the throwing mechanism upon the impact with sufficient force of a projectile on the projectile catch member.

3. The catapult of claim 2, the projectile-throwing mechanism comprises a throwing arm.

4. The catapult of claim 3, wherein the throwing arm is adapted to pivot about a substantially horizontal axis.

5. The catapult of claim 3, wherein the throwing arm defines a projectile-accepting portion for releasably holding a projectile.

6. The catapult of claim 5, wherein the projectile has a defined shape in a throwing arm-contacting portion, and the projectile-accepting portion of the throwing arm has a complementary shape.

7. The catapult of claim 2, wherein the means for automatically causing comprises a throwing arm triggering mechanism coupled to the catch member, for translating motion of the catch member into release of the throwing arm.

8. The catapult of claim 7, wherein the triggering mechanism comprises a triggering arm coupled at one end to the catch member.

9. The catapult of claim 8, wherein the triggering arm is releasably coupled to the throwing arm.

10. The catapult of claim 9, wherein the releasable coupling is accomplished with a catch.

11. The catapult of claim 9, wherein the triggering arm is adapted to pivot about an axis, to release the throwing arm from the triggering arm.

12. The catapult of claims 2, wherein the means for adjusting the projectile release angle comprises an adjustable cam mechanism that accomplishes a projectile throwing mechanism stop point.

13. The catapult of claim 2, further comprising a base for supporting the catapult on a surface.

14. The catapult of claim 13, further comprising means for rotating the projectile throwing mechanism relative to the base about a substantially vertical axis, to allow the throw position to be changed without moving the base.

15. The catapult of claim 13, wherein the base comprises a plurality of lower feet.

16. The catapult of claim 15, wherein the feet comprise a non-skid lower surface, to help maintain the catapult in position.

* * * * *